US010610935B2

(12) United States Patent
Lim et al.

(10) Patent No.: US 10,610,935 B2
(45) Date of Patent: Apr. 7, 2020

(54) METAL NANOWIRE AND METHOD OF PREPARING THE SAME

(71) Applicant: Research & Business Foundation Sungkyunkwan University, Suwon-si, Gyeonggi-do (KR)

(72) Inventors: Byungkwon Lim, Suwon-si (KR); Shingyu Bok, Asan-si (KR); Hwansu Sim, Jinju-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 240 days.

(21) Appl. No.: 15/634,214

(22) Filed: Jun. 27, 2017

(65) Prior Publication Data

US 2017/0368609 A1 Dec. 28, 2017

(30) Foreign Application Priority Data

Jun. 28, 2016 (KR) ..... 10-2016-0080983
Jun. 22, 2017 (KR) ..... 10-2017-0078946

(51) Int. Cl.

| | |
|---|---|
| ***B22F 9/24*** | (2006.01) |
| ***H01B 1/02*** | (2006.01) |
| ***H01B 13/00*** | (2006.01) |
| ***B22F 1/00*** | (2006.01) |

(52) U.S. Cl.

CPC ..... *B22F 9/24* (2013.01); *B22F 1/0025* (2013.01); *B22F 1/0044* (2013.01); *H01B 1/02* (2013.01); *H01B 13/0036* (2013.01)

(58) Field of Classification Search

None

See application file for complete search history.

(56) References Cited

U.S. PATENT DOCUMENTS

2009/0196788 A1* 8/2009 Wang ..... B22F 9/24 420/501
2013/0084210 A1* 4/2013 Wong ..... B22F 9/24 420/591
2013/0087363 A1* 4/2013 Oh ..... H01L 31/02246 174/126.1
2013/0273548 A1* 10/2013 Mastromatteo ..... B01L 3/502 435/6.12
2014/0004371 A1* 1/2014 Chung ..... H01B 1/02 428/549
2014/0251086 A1* 9/2014 Peng ..... B22F 9/24 75/343
2014/0251087 A1* 9/2014 Peng ..... B22F 9/24 75/370
2015/0047877 A1* 2/2015 Choi ..... B22F 9/24 174/126.1

(Continued)

OTHER PUBLICATIONS

B. Wiley, et al; Polyol synthesis of silver nanostructures: control of product morphology with Fe(II) or Fe(III) species; American Chemical Society; Langmuir The ACS Journal of Surfaces and Colloids; vol. 21, No. 18; Aug. 2005; 4 pp. 8077-8080.

(Continued)

*Primary Examiner* — George Wyszomierski
(74) *Attorney, Agent, or Firm* — NSIP Law

(57) ABSTRACT

The present disclosure relates to a metal nanowire having a high aspect ratio and a method of preparing the metal nanowire having a high aspect ratio without using an organic stabilizer.

10 Claims, 20 Drawing Sheets

(56) References Cited

U.S. PATENT DOCUMENTS

| | | | | |
|---|---|---|---|---|
| 2016/0332234 | A1* | 11/2016 | Balachandran | B22F 1/0025 |
| 2017/0157670 | A1* | 6/2017 | Choi | B22F 1/0025 |

OTHER PUBLICATIONS

Surfactant-Free Hydrothermal Synthesis of Ag/C Nanocables, Jianlin Mu et al., Mater. Express, vol. 2, No. 2, 2012, American Scientific Publishers.

Syntheses of Silver Nanowires in Liquid Phase, Xinling Tang et al., Nanowires Science and Technology, Book edited by: Nicoleta Lupu, ISBN 978-953-7619-89-3, pp. 402, Feb. 2010, Intech, Croatia, downloaded from sciyo.com.

* cited by examiner 100 nm

Ag

Cl 100 nm

① Ag
② Cl
Counts (a.u.)
0
100
200
300
400
500
600
Position (nm)

200 nm

Ag

Cl 200 nm

① Ag
② Cl
Counts (a.u.)
Position (nm)
0.0
0.2
0.4
0.6
0.8
1.0

METAL NANOWIRE AND METHOD OF PREPARING THE SAME

CROSS-REFERENCE TO RELATED APPLICATION

This application claims the benefit of Korean Patent Application No. 10-2016-0080983 filed Jun. 28, 2016 and Korean Patent Application No. 10-2017-0078946 filed Jun. 22, 2017, the disclosures of each of which are incorporated herein by reference.

FIELD OF THE INVENTION

The present disclosure relates to a metal nanowire having a high aspect ratio and a method of preparing the metal nanowire having a high aspect ratio without using an organic stabilizer.

BACKGROUND OF THE INVENTION

As human interface technology laying emphasis on durability, flexibility, and convenience has continued to advance, the importance of flexible electronic devices and material development has been emphasized. Flexible electrodes and materials required to drive a flexible electronic device are also being actively studied. Particularly, demands for transparent flexible electrodes and materials in the industry fields such as touch screen panel (TCP), solar cell, display, etc. are being continuously increased. Therefore, in order to gain economic and technological advantages, there is an urgent need to secure source technology.

ITO (indium tin oxide) is a representative material of transparent flexible electrodes, the price of its raw materials has been gradually increased due to limitation of reserves. Also, ITO is broken when being bent or extended due to its characteristic as oxide, and, thus, it is difficult to apply ITO to flexible electrodes. Meanwhile, a metal nanowire makes it easy to manufacture transparent flexible electrodes and is easy to be mass-produced in solution-phase, resulting in reduction of production costs. Further, the metal nanowire has an excellent mechanical characteristic of being flexibly changed according to deformation of a substrate when bent or extended. Therefore, a lot of studies are being conducted on the metal nanowire as a material of transparent flexible electrodes.

Conventionally, as a silver nanowire synthesis method, a method using poly(vinylpyrrolidone) (PVP) which is a polymeric stabilizer and various organic stabilizers on the basis of an ethylene glycol (EG)-based polyol synthesis method has been mainly studied [B. Wiley, Y. Sun, Y. Xia, Langmuir 21 (2005) 8077.]. However, if the organic stabilizers are used, when a nanowire is applied to an electrode, an organic stabilizer remaining on a surface of the nanowire may cause an increase in resistance and a washing process for removing the organic stabilizer on the nanowire surface needs to be repeated to obtain a high conductivity.

SUMMARY OF THE INVENTION

In view of the foregoing, the present disclosure provides a metal nanowire having a high aspect ratio and a method of preparing the metal nanowire having a high aspect ratio without using an organic stabilizer.

However, problems to be solved by the present disclosure are not limited to the above-described problems. Although not described herein, other problems to be solved by the present disclosure can be clearly understood by those skilled in the art from the following descriptions.

According to a first aspect of the present disclosure, there is provided a method of preparing a metal nanowire, including adding a metal precursor and a salt into a solvent and making a reaction to form a metal nanowire. Herein, an organic stabilizer is not used.

According to a second aspect of the present disclosure, there is provided a metal nanowire which is prepared without using an organic stabilizer and has an aspect ratio (length/diameter) of 5 or more.

The present disclosure relates to a high-aspect-ratio metal nanowire for transparent flexible electrodes and a method of preparing the metal nanowire which does not use an organic stabilizer unlike a conventional metal nanowire synthesis method and in which the metal nanowire is prepared by adding a salt on the basis of a polyol synthesis method.

According to an exemplary embodiment of the present disclosure, a metal nanowire having a high aspect ratio suitable for transparent flexible electrode devices can be synthesized by adding a salt without using an organic stabilizer. Specifically, when a salt is added, metal sediment is formed. The sediment serves as heterogeneous nucleants and provides a nucleation site, and, thus, a metal nanowire can grow. The metal sediment generated the added salt is formed at a relatively low temperature, which makes it possible to synthesize the metal nanowire even at a low temperature.

Further, metal nanowires prepared according to an exemplary embodiment of the present disclosure are thin with an average length of about 40 μm and an average thickness of about 50 nm or less. Therefore, when applied to a transparent flexible device, the metal nanowires have an advantage of being able to suppress a decrease in transparency caused by haze and nanoparticles. Also, the obtained metal nanowires have a yield of 90% or more with respect to an added metal precursor. Accordingly, if they are commercialized, it is possible to gain global market competitiveness of the source technology.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION OF THE INVENTION

Figure 1:
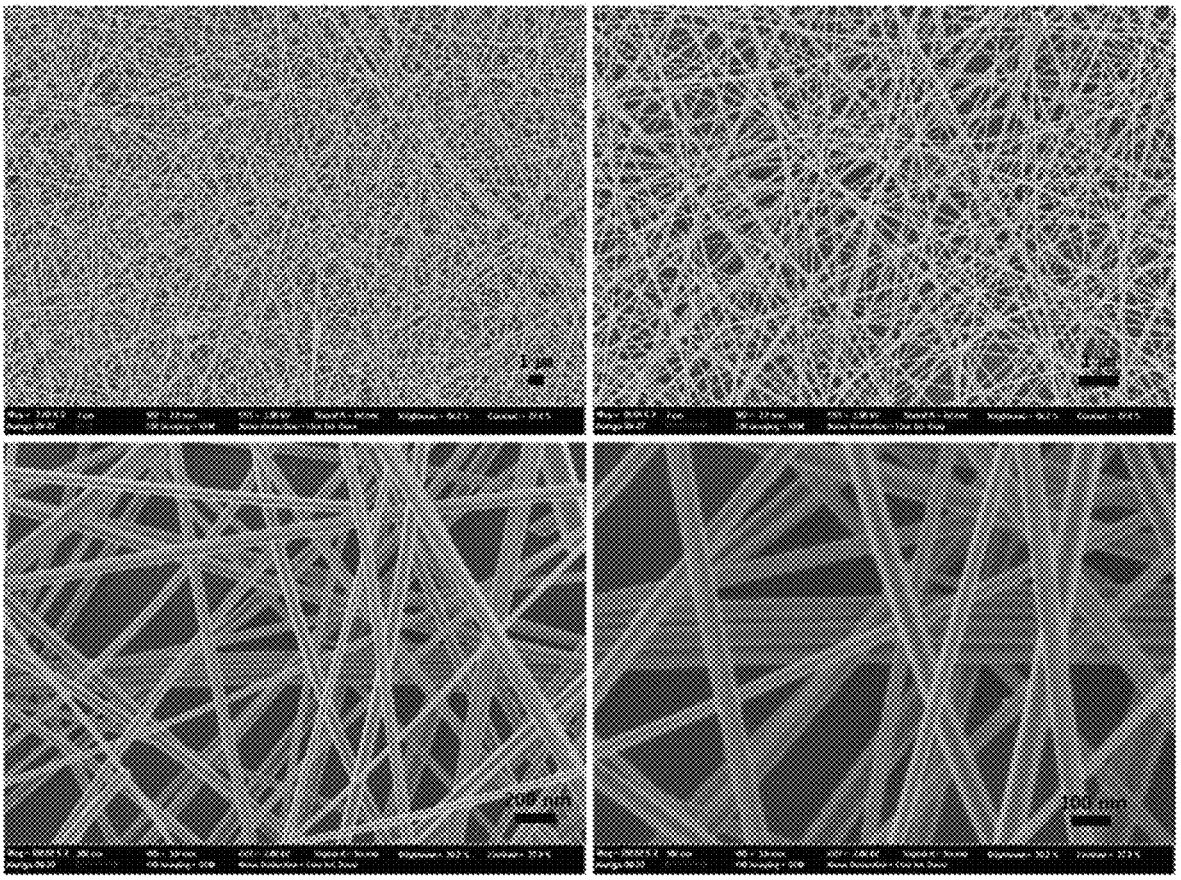
FIG. 1 shows low-magnification and high-magnification scanning electron microscope (SEM) images of high-aspect-ratio silver nanowires synthesized using a combination of iron(III) nitrate and sodium chloride as salts, according to an example of the present disclosure.

Hereinafter, examples of the present disclosure will be described in detail with reference to the accompanying drawings so that the present disclosure may be readily implemented by those skilled in the art. However, it is to be noted that the present disclosure is not limited to the examples but can be embodied in various other ways. In drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the another element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise. Through the whole document, the term "about or approximately" or "substantially" is intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

Through the whole document, the term "combination(s) of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Through the whole document, a phrase in the form "A and/or B" means "A or B, or A and B".

Hereinafter, embodiments and examples of the present disclosure will be described in detail with reference to the accompanying drawings. However, the present disclosure may not be limited to the following embodiments, examples and drawings.

According to a first aspect of the present disclosure, there is provided a method of preparing a metal nanowire, comprising adding a metal precursor and a salt into a solvent and making a reaction to form a metal nanowire. Herein, an organic stabilizer is not used.

According to exemplary embodiments of the present disclosure, a metal nanowire having a high aspect ratio suitable for transparent flexible electrode devices can be prepared by adding a salt without using an organic stabilizer unlike a conventional metal nanowire synthesis method. Further, metal nanowires prepared according to an exemplary embodiment of the present disclosure are thin with an average length of about 40 μm and an average thickness of about 50 nm or less. Therefore, when applied to a transparent flexible device, the metal nanowires have an advantage of being able to suppress a decrease in transparency caused by haze and nanoparticles. Also, the obtained metal nanowires have a yield of 90% or more with respect to an added metal precursor. Accordingly, if they are commercialized, it is possible to gain global market competitiveness of the source technology.

According to an exemplary embodiment of the present disclosure, the metal nanowire may have an aspect ratio of about 5 or more, but may not be limited thereto. By way of example, the aspect ratio of the metal nanowire may be from about 5 or more, about 10 or more, about 100 or more, about 300 or more, about 500 or more, about 700 or more, or about 720 or more, but may not be limited thereto. And by way of example the aspect ratio of the metal nanowire may be from about 5 to about 5,000, from about 10 to about 5,000, from about 100 to about 5,000, from about 300 to about 5,000, from about 500 to about 5,000, from about 700 to about 5,000, or from about 720 to about 5,000, but may not be limited thereto.

According to an exemplary embodiment of the present disclosure, the salt may include a halide group, a nitrate group, a sulfide group, an acetate group, or a sulfate group. Preferably, the salt is a compound containing a halide group.

According to an exemplary embodiment of the present disclosure, the salt may include hydrogen halide selected from the group consisting of HCl, HBr, HI and combinations thereof.

According to an exemplary embodiment of the present disclosure, the salt may include a compound represented by the following Chemical Formula 1:

$$MA_n \quad \text{[Chemical Formula 1]}$$

In Chemical Formula 1, M includes a metal selected from the group consisting of alkali metals, Ni, Al, Cu, Co, Mn, Fe, Na, K, Ru, Au, Pt, Sn, Pd, Zn, Ti, Ir, Ce, Ag, and combinations thereof, A includes a halide group, a nitrate group, a sulfide group, an acetate group, or a sulfate group, and n is 1 to 3.

According to an exemplary embodiment of the present disclosure, the metal precursor solution may be reduced by the organic solvent to form a reduced metal precursor.

According to an exemplary embodiment of the present disclosure, the salt may include one or more kinds of metals selected from the group consisting of halide salts, nitrate salts, acetate salts, sulfide salts, and sulfate salts of metals. For example, the salt may include one or more kinds of salts selected from the group consisting of halides of alkali metals, sulfide salts of alkali metals, halide salts of Ag, sulfate salts of Ag, sulfide salts of Ag, nitrate salts of $Fe^{3+}$, acetate salts of $Fe^{3+}$, sulfate salts of $Fe^{3+}$, halide salts of $Fe^{3+}$, and combinations thereof.

According to an exemplary embodiment of the present disclosure, the salt may include a combination of a first salt including halides or sulfide salts of alkali metals and halide salts or sulfide salts of Ag metal and a second salt including nitrates of $Fe^{3+}$, halides of $Fe^{3+}$, an acetate group, or sulfate salts.

According to an exemplary embodiment of the present disclosure, an equivalence ratio of the first salt and the second salt may be in the range of from about 0.01 to about 1,000.

According to an exemplary embodiment of the present disclosure, the salt may include one or two kinds or two or more kinds of salts selected from the group consisting of KCl, NaCl, KBr, NaBr, KI, NaI, LiCl, LiBr, LiI, AgCl, AgBr, AgI, $Ag_2S$, $FeCl_3$, $FeBr_3$, $Fe(NO_3)_3$, $Fe_2(SO_4)_3$, and $Fe(acac)_3$.

According to another exemplary embodiment of the present disclosure, the salt may include one or more kinds of salts selected from the group consisting of NaCl, $Na_2S$, KBr, NaBr, AgCl, $FeCl_3$, and $Fe(NO_3)_3$.

According to an exemplary embodiment of the present disclosure, when the metal precursor and the salt are added into the solvent, a solution of the salt may be first added and then a solution of the metal precursor may be added, or may be added at the same time, but may not be limited thereto.

According to an exemplary embodiment of the present disclosure, the method of preparing a metal nanowire may include preparing a metal precursor solution and a salt solution by dissolving the metal precursor and the salt, respectively, in the solvent, making a reaction solution prepared by adding the metal precursor solution and the salt solution into the solvent at an appropriate temperature for an appropriate reaction time to form a metal nanowire, but may not be limited thereto.

According to an exemplary embodiment of the present disclosure, during the reaction, the salt dissolved in the solvent may promote an environment for nanowire shape without an organic stabilizer and form a metal nanowire having a high aspect ratio, but may not be limited thereto.

According to an exemplary embodiment of the present disclosure, the solvent may include a pre-heated solvent, but may not be limited thereto.

According to an exemplary embodiment of the present disclosure, a pre-heating temperature for the solvent may be from about 25° C. to about 300° C., but may not be limited thereto. By way of example, a pre-heating temperature for the solvent may be from about 25° C. to about 300° C., from about 25° C. to about 280° C., from about 25° C. to about 260° C., from about 25° C. to about 250° C., from about 25° C. to about 240° C., from about 25° C. to about 230° C., from about 25° C. to about 220° C., from about 25° C. to about 210° C., from about 25° C. to about 200° C., from about 25° C. to about 190° C., from about 25° C. to about 210° C., from about 35° C. to about 250° C., from about 45° C. to about 250° C., from about 55° C. to about 250° C., or from about 65° C. to about 250° C., from about 75° C. to about 250° C., from about 85° C. to about 250° C., from about 95° C. to about 250° C., or from about 105° C. to about 250° C., but may not be limited thereto.

According to an exemplary embodiment of the present disclosure, if each of the metal precursor solution and the salt solution is prepared and added into the solvent to make a reaction, each of the metal precursor solution and the salt solution and the solvent may be pre-heated before the reaction, and a pre-heating temperature for each of them may be from about 25° C. to about 300° C., from about 25° C. to about 280° C., from about 25° C. to about 260° C., from about 25° C. to about 250° C., from about 25° C. to about 240° C., from about 25° C. to about 230° C., from about 25° C. to about 220° C., from about 25° C. to about 210° C., from about 25° C. to about 200° C., from about 25° C. to about 190° C., from about 25° C. to about 210° C., from about 35° C. to about 250° C., from about 45° C. to about 250° C., from about 55° C. to about 250° C., or from about 65° C. to about 250° C., from about 75° C. to about 250° C., from about 85° C. to about 250° C., from about 95° C. to about 250° C., or from about 105° C. to about 250° C., but may not be limited thereto.

According to an exemplary embodiment of the present disclosure, in the solvent, a temperature of the reaction between the metal precursor and the salt may be from about 25° C. to about 300° C., but may not be limited thereto. By way of example, a temperature of the reaction may be from about 25° C. to about 300° C., from about 25° C. to about 280° C., from about 25° C. to about 260° C., from about 25° C. to about 250° C., from about 25° C. to about 240° C., from about 25° C. to about 230° C., from about 25° C. to about 220° C., from about 25° C. to about 210° C., from about 25° C. to about 200° C., from about 25° C. to about 190° C., from about 25° C. to about 210° C., from about 35° C. to about 250° C., from about 45° C. to about 250° C., from about 55° C. to about 250° C., or from about 65° C. to about 250° C., from about 75° C. to about 250° C., from about 85° C. to about 250° C., from about 95° C. to about 250° C., or from about 105° C. to about 250° C., but may not be limited thereto.

According to an exemplary embodiment of the present disclosure, in the solvent, a reaction time between the metal precursor and the salt may be from about 1 minute to about 48 hours, from about 1 minute to about 40 hours, from about 1 minute to about 35 hours, from about 1 minute to about 25 hours, from about 1 minute to about 20 hours, from about 1 minute to about 15 hours, from about 1 minute to about 10 hours, from about 1 minute to about 5 hours, from about 1 minute to about 3 hours, from about 1 minute to about 1 hours, from about 1 minute to about 50 minutes, from about 1 minute to about 40 minutes, from about 1 minute to about 30 munities, from about 1 minute to about 20 minutes, from about 1 minute to about 10 minutes, from about 10 minutes to about 48 hours, from about 10 minutes to about 40 hours, from about 10 minutes to about 35 hours, from about 10 minutes to about 25 hours, from about 10 minutes to about 20 hours, from about 10 minutes to about 15 hours, from about 10 minutes to about 10 hours, from about 10 minutes to about 5 hours, or from about 10 minutes to about 3 hours, from about 10 minutes to about 1 hours, from about 10 minutes to about 50 minutes, from about 10 minutes to about 40 minutes, from about 10 minutes to about 30 minutes, or from about 10 minutes to about 20 minutes, but may not be limited thereto.

According to an exemplary embodiment of the present disclosure, the solvent may include an organic solvent. For example, the organic solvent may include polyol, but may not be limited thereto. By way of example, the polyol may include at least one material selected from the group consisting of ethylene glycol, propylene glycol, butylene glycol, butanediol, pentanediol, hexanediol, diethylene glycol, triethylene glycol, tetraethylene glycol, polyethylene glycol, glycerol, and combinations thereof, but may not be limited thereto.

According to an exemplary embodiment of the present disclosure, the method may further include solvent substitution via centrifugation after the metal nanowire is synthesized, but may not be limited thereto. The solvent substitution may include mixing the synthesized metal nanowire and a solvent for substitution, precipitating the metal nanowire via centrifugation and draining the solution, and repeatedly dispersing the metal nanowire in the solvent for substitution two times, but may not be limited thereto. Through the solvent substitution, the unreacted metal precursor and salt remaining in the solution in which the metal nanowire is synthesized may be removed, but may not be limited thereto.

According to an exemplary embodiment of the present disclosure, the solvent for substitution used in the solvent substitution may include ultrapure water, or alcohols having 1 to 6 carbon atoms (non-limited example: a member selected from the group consisting of ethyl alcohol, propyl alcohol, butyl alcohol, and combinations thereof), but may not be limited thereto.

According to an exemplary embodiment of the present disclosure, the metal precursor may be a material for supplying metal ions for synthesis of metal nanowires, and the metal precursor may include a salt of silver (Ag), but may not be limited thereto. By way of example, the metal precursor may include a member selected from the group consisting of silver nitrate, silver silicate, silver trifluoroacetate, silver acetate, silver chloride, silver bromide, silver acetylacetonate, silver iodide, silver sulfide, and combinations thereof, but may not be limited thereto. The metal precursor may employ a known compound including silver (Ag).

According to an exemplary embodiment of the present disclosure, the metal precursor solution may be reduced by the organic solvent to form a reduced metal precursor, but may not be limited thereto.

According to a second aspect of the present disclosure, there is provided a metal nanowire which is prepared without using an organic stabilizer and has an aspect ratio of 5 or more. The metal nanowire is prepared by the method according to the first aspect of the present disclosure, and, thus, an organic stabilizer is not detected from a surface of the metal nanowire and the metal nanowire has a high aspect ratio of 5 or more.

Detailed descriptions of the parts, which overlap with those of the first aspect of the present disclosure, are omitted hereinafter, but the descriptions of the first aspect of the present disclosure may be identically applied to the second aspect of the present disclosure, even though they are omitted hereinafter.

According to an exemplary embodiment of the present disclosure, the metal nanowire may have an aspect ratio of about 5 or more, but may not be limited thereto. By way of example, the aspect ratio may be about 5 or more, about 10 or more, about 100 or more, about 300 or more, about 500 or more, about 700 or more, or about 720 or more, and for example, the aspect ratio of the metal nanowire may be from about 5 to about 5,000, from about 10 to about 5,000, from about 100 to about 5,000, from about 300 to about 5,000, from about 500 to about 5,000, from about 700 to about 5,000, or from about 720 to about 5,000, but may not be limited thereto.

According to an exemplary embodiment of the present disclosure, the metal nanowire may include a silver (Ag) nanowire from a surface of which an organic stabilizer is not detected and which has a high aspect ratio of 5 or more, but may not be limited thereto.

According to an exemplary embodiment of the present disclosure, the metal nanowire may apply to transparent flexible electrode, but may not be limited thereto.

Hereinafter, embodiment of the present disclosure will be described in detail. But the present disclosure may not be limited thereto.

EXAMPLES

Example 1: Synthesis of Silver Nanowire Based on Iron(III) Nitrate and Sodium Chloride A silver nanowire was synthesized using silver nitrate ($AgNO_3$, Sigma-Aldrich) as a metal precursor, sodium chloride (NaCl, Samchun) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 30 mM sodium chloride-ethylene glycol solution and a 40 mM iron(III) nitrate-ethylene glycol solution (salt-containing solutions) were prepared by dissolving sodium chloride and iron(III) nitrate, respectively, in ethylene glycol.

After 6.32 mL of the ethylene glycol was pre-heated at 110° C. for 1 hour, 150 μL of the iron(III) nitrate-ethylene glycol solution and 30 μL of the sodium chloride-ethylene glycol solution were added thereto. 20 minutes later, 1.5 mL of the silver nitrate-ethylene glycol solution was added to the solution and then the reaction solution was reacted at 110° C. for 15 hours without stirring.

In order to perform solvent substitution, 27 mL of isopropyl alcohol (IPA) was added to a silver nanowire solution synthesized through the above-described process with stirring and then centrifuged at 3,000 rpm for 10 munities. After the centrifugation, the solution was removed and 35 mL of new IPA was added thereto and then centrifuged at 3,000 rpm for 10 minutes. Then, the solution was removed and then the reaction product was dispersed in 10 mL of new IPA. Through the solvent substitution, any additive and ethylene glycol solution remaining in the synthesized silver nanowire solution were separated and substituted with an alcohol-based solvent. Thus, a silver nanowire suitable for implementation of transparent electrodes was obtained.

Figure 2:
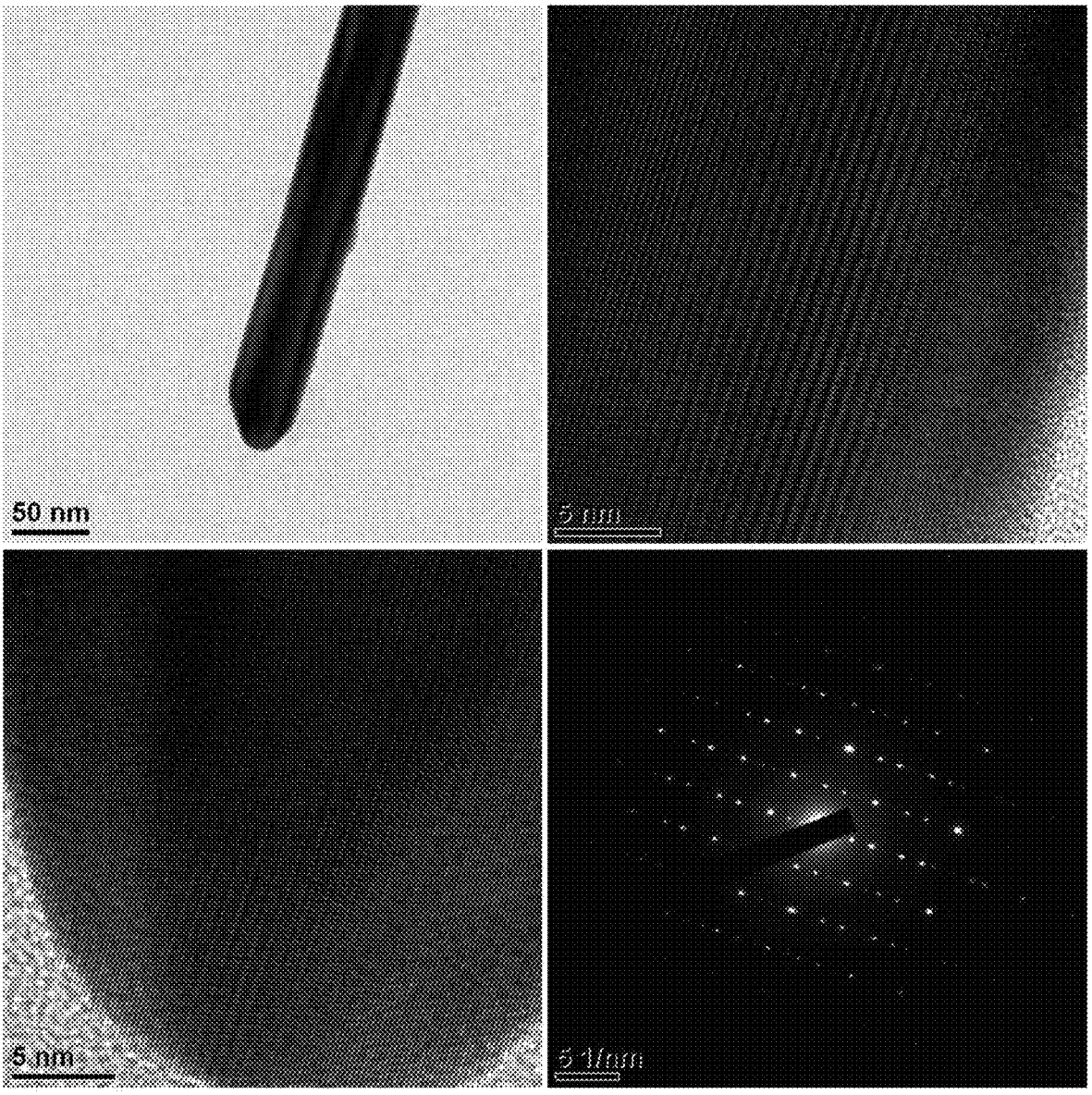
FIG. 2 shows a transmission electron microscope (TEM) image, a high-resolution TEM (HRTEM) image, and an electron diffraction (ED) pattern of a silver nanowire synthesized using a combination of iron(III) nitrate and sodium chloride as salts, according to an example of the present disclosure.
Figure 3:
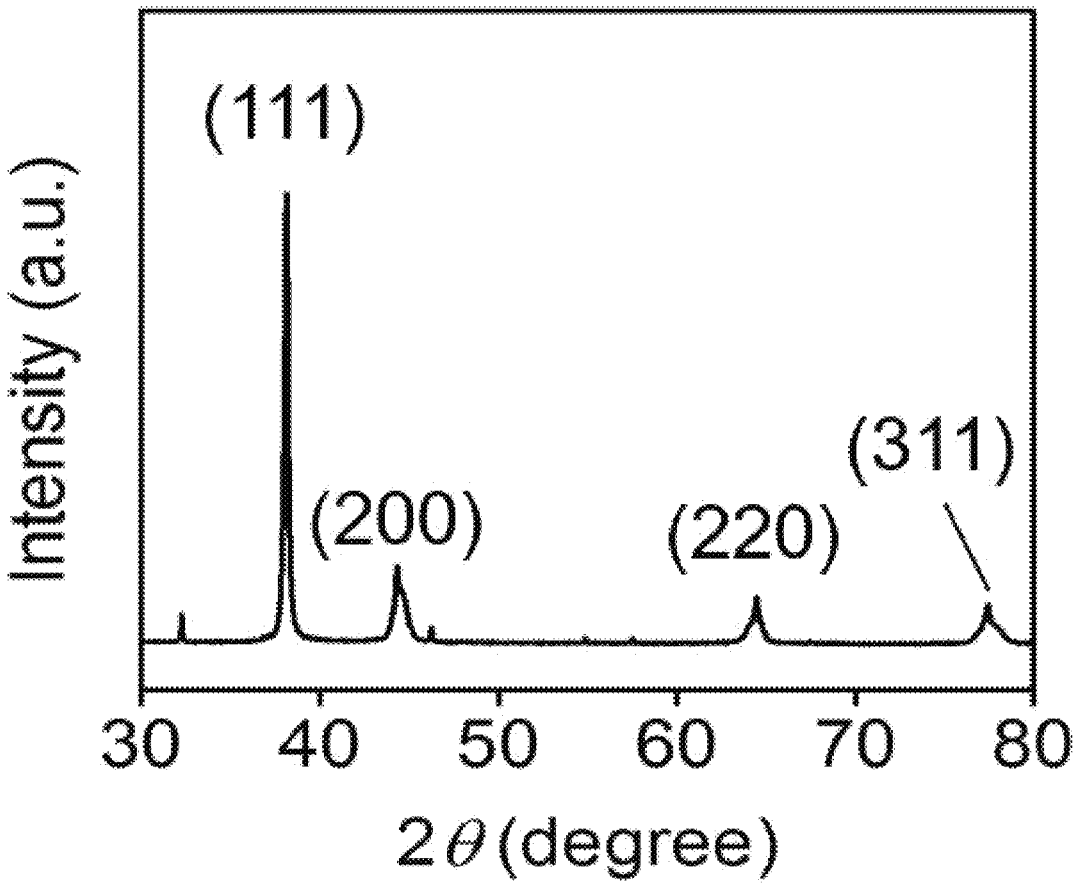
FIG. 3 shows an X-ray diffraction (XRD) pattern of a silver nanowire synthesized using a combination of iron(III) nitrate and sodium chloride as salts, according to an example of the present disclosure.
Figure 4:
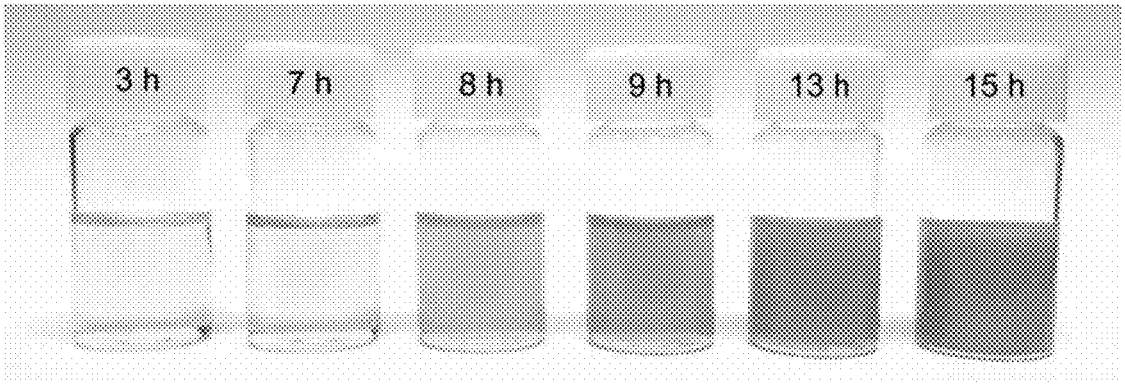
FIG. 4 shows images of a reaction solution for a silver nanowire synthesized using a combination of iron(III) nitrate and sodium chloride as salts over reaction time, according to an example of the present disclosure.

FIG. 1 and FIG. 2 provide SEM images and TEM images showing a high aspect ratio of the obtained silver nanowire. FIG. 3 shows an XRD pattern of the silver nanowire synthesized according to Example 1. The XRD pattern shown in FIG. 3 was matched with a JCPDS card and confirmed that Ag metal peaks (JCPDS file No. 04-0783) were at 2 theta values 38.1°, 44.3°, and 64.5° and 77.4° was indexed to (111), (200), (220), and (311) reflections. FIG. 4 shows images of the reaction solution over reaction time (3, 7, 8, 9, 13, and 15 hours) when the silver nanowire was synthesized according to Example 1. At an early stage of reaction where an Ag nanowire was not yet formed, the reaction solution appeared transparent yellow. The Ag nanowire was formed over reaction time, and, thus, the reaction solution was observed as turning dark gray, i.e., color of Ag metal, which indicates the formation of a Ag metal nanowire. Until 7 hours at the early stage of reaction, a color change of the reaction solution was not observed, but after 7 hours, a reaction product showing a color of Ag was formed, and, thus, the color of Ag was gradually darkened.

That is, referring to FIG. 4, until 7 hours at the early stage of reaction, AgCl was formed, and after 8 hours, cores of AgCl particles were formed of AgCl and nodules and rods on the particles were formed of Ag metal, and, thus, it can be seen that Ag nanowires are extended from and based on AgCl particles.

Figure 5:
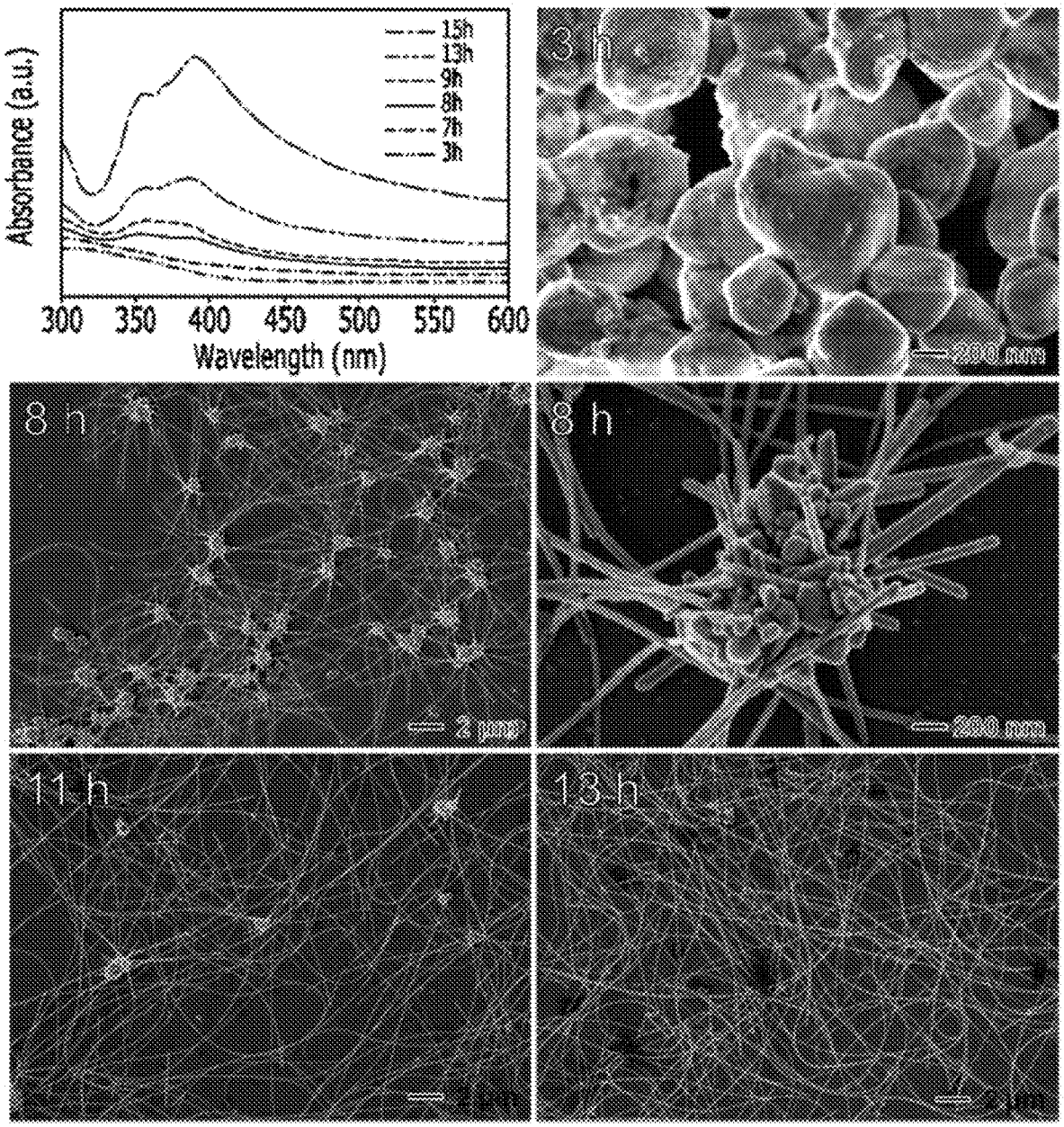
FIG. 5 shows UV-vis spectra and SEM images of a silver nanowire synthesized using a combination of iron(III) nitrate and sodium chloride as salts over reaction time, according to an example of the present disclosure.

FIG. 5 shows UV-vis spectra and SEM images of the reaction solution over reaction time (3, 7, 8, 9, 13, and 15 hours) when the silver nanowire was synthesized according to Example 1. According to the UV-vis spectra, 355 and 385 nm peaks indicating silver nanowires appeared after 9 h.

Figures 6A, 6B, 6C, 6D, 6E:
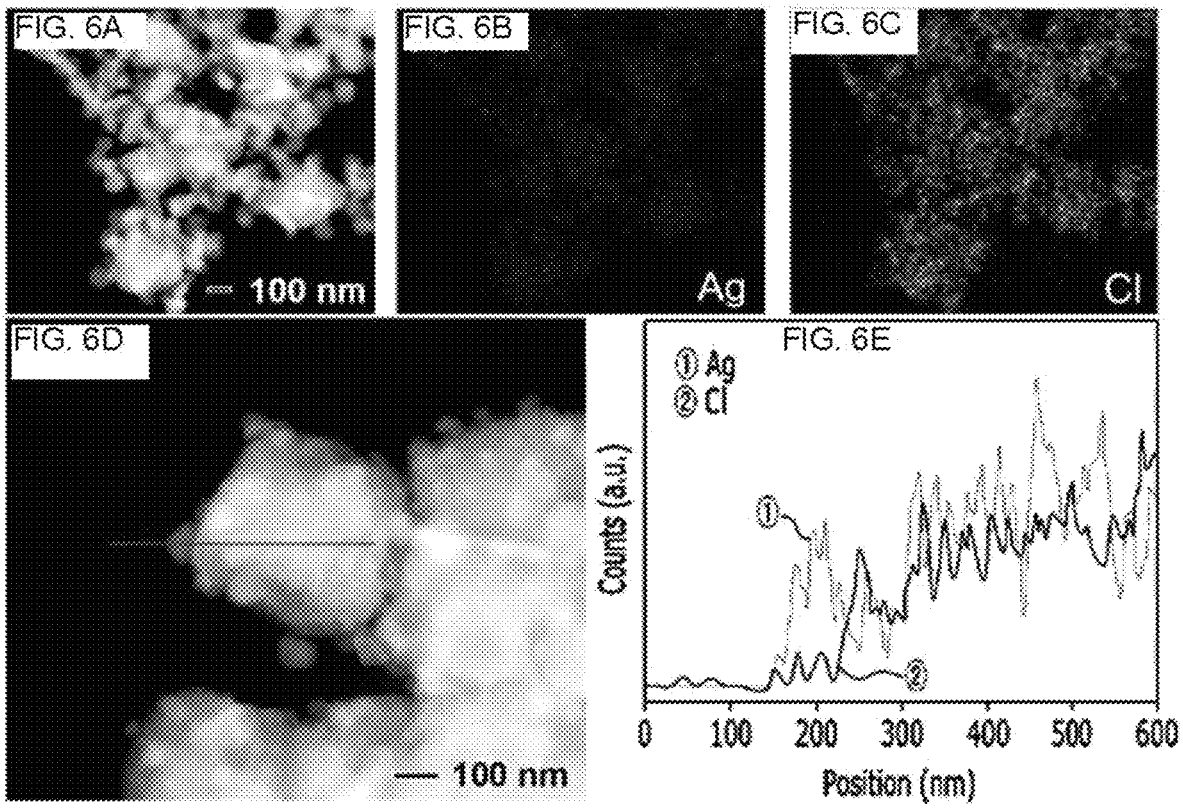
FIG. 6 shows high-angle annular dark-field scanning transmission electron microscope (HAADF-STEM) image [FIG. 6(A) and FIG. 6(D)], energy dispersive X-ray spectrometry (EDS) elemental mapping image[FIG. 6(B) and FIG. 6(C)], and line profile[FIG. 6(E)] of a synthetic product reacted for 3 hours when a silver nanowire is synthesized using a combination of iron(III) nitrate and sodium chloride as salts, according to an example of the present disclosure.
Figure 7A:
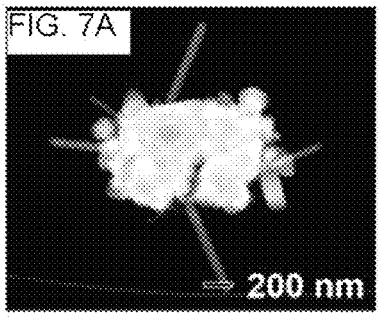
FIG. 7 shows high-angle annular dark-field scanning transmission electron microscope (HAADF-STEM) image [FIG. 7(A) and FIG. 7(D)], energy dispersive X-ray spectrometry (EDS) elemental mapping image[FIG. 7(B) and FIG. 7(C)], and line profile[FIG. 7(E)] of a synthetic product reacted for 9 hours when a silver nanowire is synthesized using a combination of iron(III) nitrate and sodium chloride as salts, according to an example of the present disclosure.
Figure 7B:
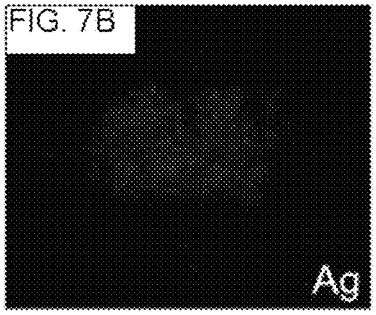
Figure 7C:
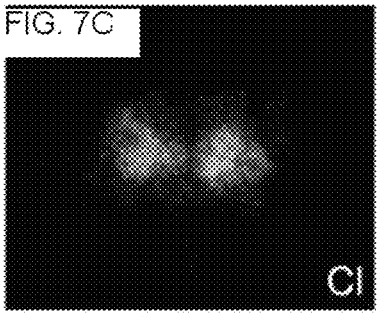
Figure 7D:
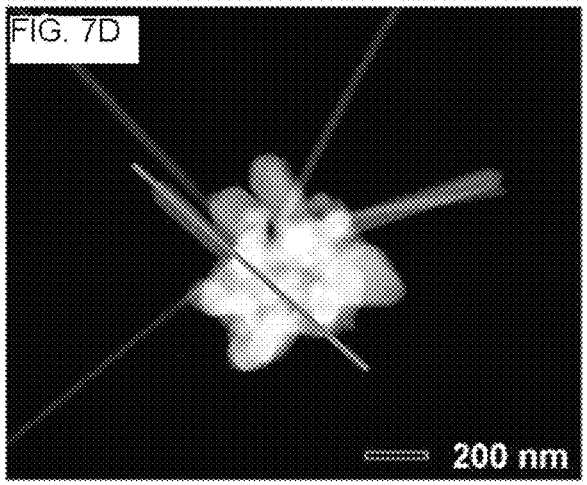
Figure 7E:
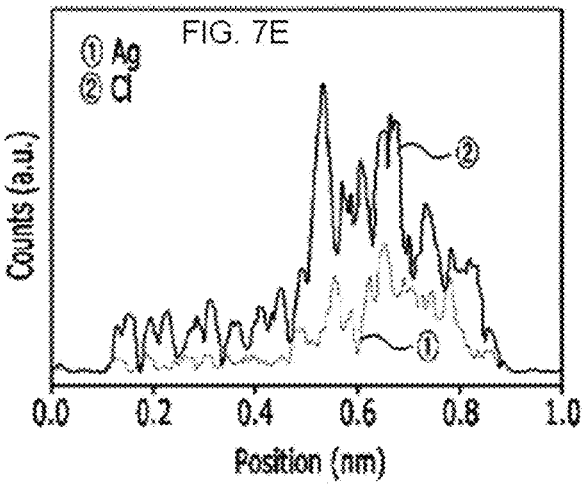

FIG. 6(*a*) to FIG. 6(*e*) respectively show a STEM image [FIG. 6(*a*) and FIG. 6(*d*)], elemental mapping image of the FIG. 6(*a*) [FIG. 6(*b*) and FIG. 6(*c*)] and a line profile [FIG. 6 (*e*)], respectively, of a silver nanowire solution obtained after reaction for 3 hours according to Example 1.

FIG. 7(*a*) to FIG. 7(*e*) respectively show a STEM image [FIG. 7(*a*) and FIG. 7(*d*)], element mapping image of the FIG. 7(*a*) [FIG. 7(*b*) and FIG. 7(*c*)] and a line profile [FIG. 7(*e*)], respectively, of a silver nanowire solution obtained after reaction for 9 hours according to Example 1.

FIG. 6 and FIG. 7 show that cores of the prepared silver particles are formed of AgCl, nodules and rods on the silver particles are formed of Ag metal and Ag nanowires (Ag NWs) are formed based on AgCl particles.

Figure 8:
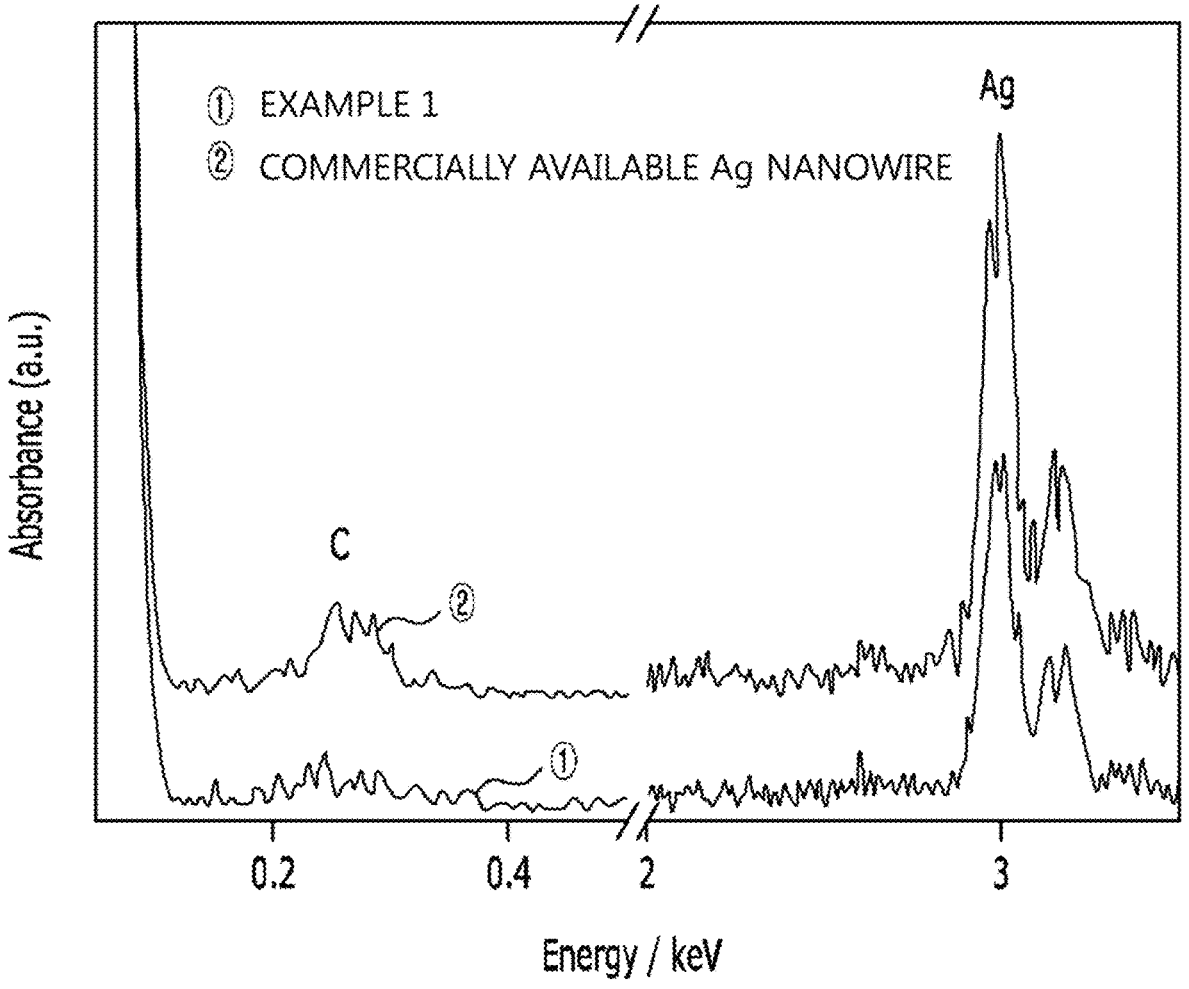
FIG. 8 is a graph comparing an EDS spectrum of a silver nanowire according to Example 1 of the present disclosure with an EDS spectrum of a commercially available silver nanowire.

FIG. 8 is a graph comparing an EDS spectrum of the silver nanowire according to Example 1 with an EDS spectrum of a commercially available silver nanowire (Nanopyxis) prepared by adding an organic stabilizer such as PVP according to the prior art. Referring to FIG. 8, it can be seen that the silver nanowire according to Example 1 contains less carbon than the commercially available silver nanowire, which means that an organic stabilizer is not detected from a surface of the silver nanowire synthesized according to Example 1.

Example 2: Synthesis of Silver Nanowire Based on Iron(III) Nitrate and Sodium Chloride Depending on Change in Synthesis Temperature A silver nanowire was synthesized using silver nitrate ($AgNO_3$, Sigma-Aldrich) as a metal precursor, sodium chloride (NaCl, Samchun) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 30 mM sodium chloride-ethylene glycol solution and a 40 mM iron(III) nitrate-ethylene glycol solution (salt-containing solutions) were prepared by dissolving sodium chloride and iron(III) nitrate, respectively, in ethylene glycol.

After 6.32 mL of the ethylene glycol was pre-heated at 120° C. for 1 hour, 150 μL of the iron(III) nitrate-ethylene glycol solution and 30 μL of the sodium chloride-ethylene glycol solution were added thereto. 20 minutes later, 1.5 mL of the silver nitrate-ethylene glycol solution was added to the solution and then the reaction solution was reacted at 120° C. for 15 hours without stirring.

In the same manner as Example 1, solvent substitution was performed to a silver nanowire solution synthesized through the above-described process. Thus, silver nanowires were obtained.

Figure 9:
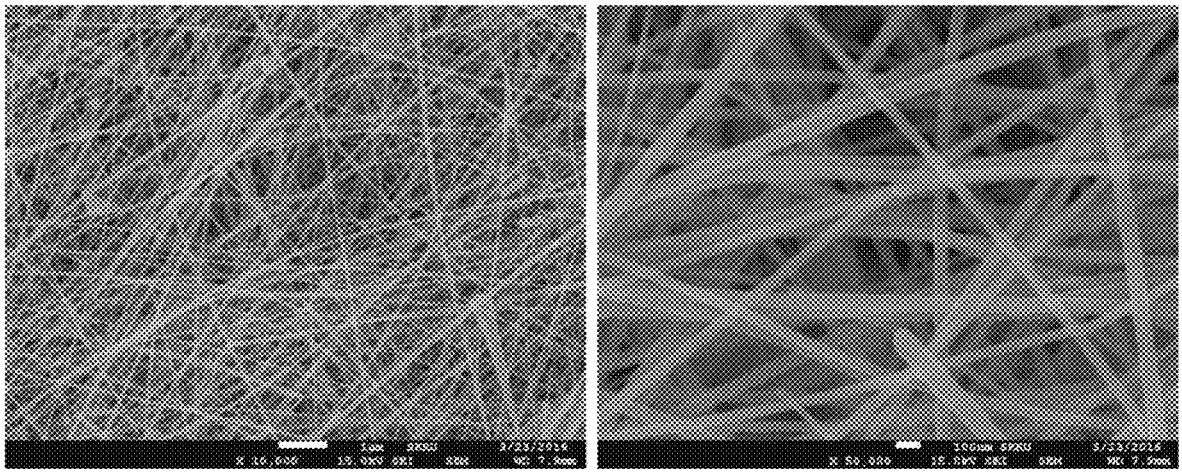
FIG. 9 shows SEM images of silver nanowires synthesized at 120° C. using a combination of iron(III) nitrate and sodium chloride as salts, according to an example of the present disclosure.

FIG. 9 shows SEM images of the silver nanowires prepared according to Example 2 and confirms a high yield of silver nanowires.

Example 3: Synthesis of Silver Nanowire Based on Iron(III) Nitrate and Sodium Chloride Depending on Change in Synthesis Temperature and Reaction Time A silver nanowire was synthesized using silver nitrate ($AgNO_3$, Sigma-Aldrich) as a metal precursor, sodium chloride (NaCl, Samchun) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 30 mM sodium chloride-ethylene glycol solution and a 40 mM iron(III) nitrate-ethylene glycol solution (salt-containing solutions) were prepared by dissolving sodium chloride and iron(III) nitrate, respectively, in ethylene glycol.

After 6.32 mL of the ethylene glycol was pre-heated at 100° C. or 160° C. for 1 hour, 150 μL of the iron(III) nitrate-ethylene glycol solution and 30 μL of the sodium chloride-ethylene glycol solution were added thereto. 20 minutes later, 1.5 mL of the silver nitrate-ethylene glycol solution was added to the solution and then the reaction solution was reacted at 100° C. for 42 hours or at 160° C. for 30 minutes without stirring.

Figure 10:
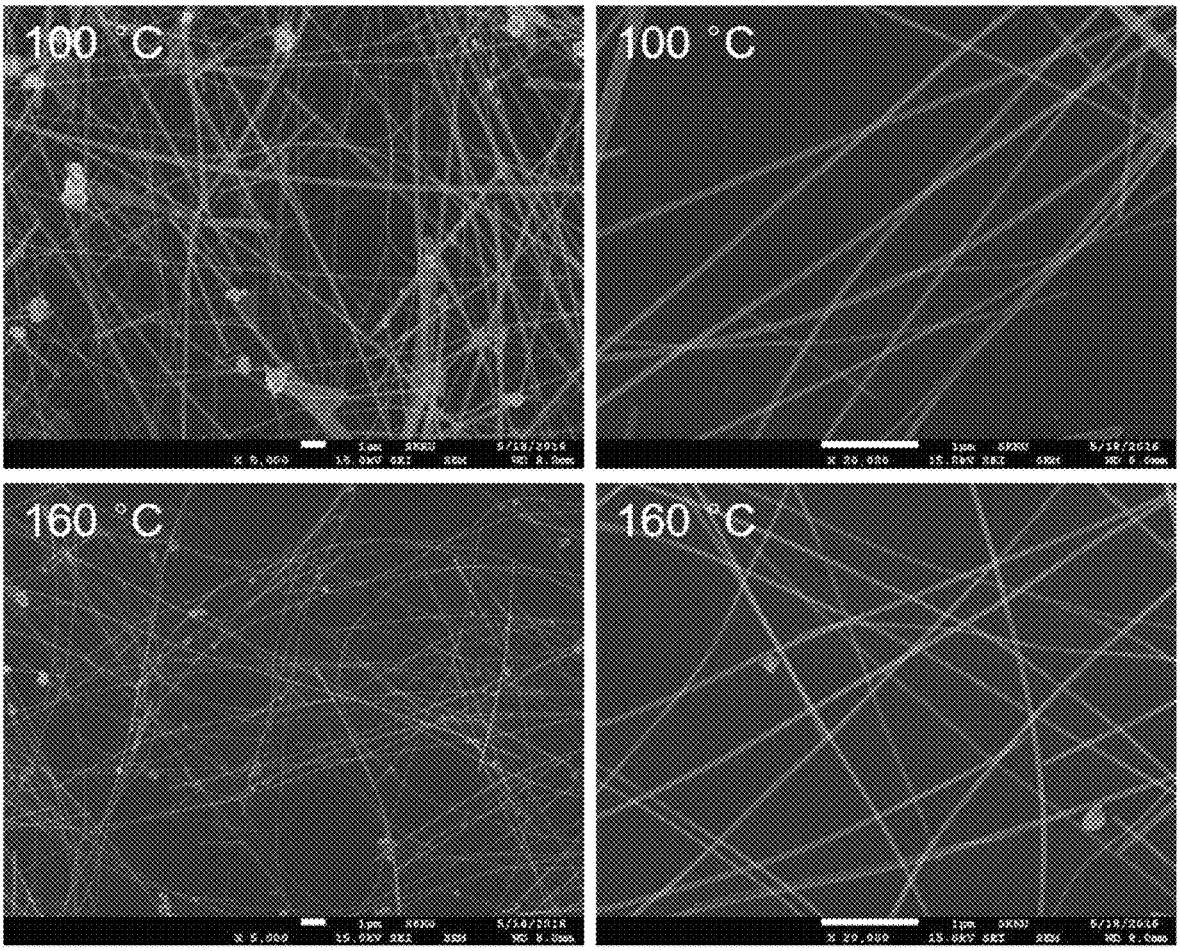
FIG. 10 shows low-magnification and high-magnification SEM images of silver nanowires synthesized depending on change in reaction temperature and reaction time, according to an example of the present disclosure.

In the same manner as Example 1, solvent substitution was performed to a silver nanowire solution synthesized through the above-described process. Thus, silver nanowires were obtained. FIG. 10 shows SEM images of the silver nanowires prepared via reaction at 100° C. or 160° C. according to Example 3.

Example 4: Synthesis of Silver Nanowire Based on Iron(III) Nitrate and Potassium Bromide A silver nanowire was synthesized using silver nitrate ($AgNO_3$, Sigma-Aldrich) as a metal precursor, potassium bromide (KBr, Sigma-Aldrich) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 30 mM potassium bromide-ethylene glycol solution and a 40 mM iron(III) nitrate-ethylene glycol solution (salt-containing solutions) were prepared by dissolving potassium bromide and iron(III) nitrate, respectively, in ethylene glycol.

After 6.32 mL of the ethylene glycol was pre-heated at 110° C. for 1 hour, 150 μL of the iron(III) nitrate-ethylene glycol solution and 30 μL of the potassium bromide-ethylene glycol solution were added thereto. 20 minutes later, 1.5 mL of the silver nitrate-ethylene glycol solution was added to the solution and then the reaction solution was reacted at 110° C. for 15 hours without stirring.

In the same manner as Example 1, solvent substitution was performed to a silver nanowire solution synthesized through the above-described process. Thus, silver nanowires were obtained.

Example 5: Synthesis of Silver Nanowire Based on Iron(III) Nitrate and Sodium Bromide A silver nanowire was synthesized using silver nitrate ($AgNO_3$, Sigma-Aldrich) as a metal precursor, sodium bromide (NaBr, Sigma-Aldrich) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 30 mM sodium bromide-ethylene glycol solution and a 40 mM iron(III) nitrate-ethylene glycol solution (salt-containing solutions) were prepared by dissolving sodium bromide and iron(III) nitrate, respectively, in ethylene glycol.

After 6.32 mL of the ethylene glycol was pre-heated at 110° C. for 1 hour, 150 μL of the iron(III) nitrate-ethylene glycol solution and 30 μL of the sodium bromide-ethylene glycol solution were added thereto. 20 minutes later, 1.5 mL of the silver nitrate-ethylene glycol solution was added to the solution and then the reaction solution was reacted at 110° C. for 15 hours without stirring.

In the same manner as Example 1, solvent substitution was performed to a silver nanowire solution synthesized through the above-described process. Thus, silver nanowires were obtained.

Example 6: Synthesis of Silver Nanowire Based on Iron(III) Nitrate and Sodium Sulfide A silver nanowire was synthesized using silver nitrate ($AgNO_3$, Sigma-Aldrich) as a metal precursor, sodium sulfide ($Na_2S$, Sigma-Aldrich) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 30 mM sodium sulfide-ethylene glycol solution and a 40 mM iron (III) nitrate-ethylene glycol solution (salt-containing solutions) were prepared by dissolving sodium sulfide and iron(III) nitrate, respectively, in ethylene glycol.

After 6.32 mL of the ethylene glycol was pre-heated at 110° C. for 1 hour, 150 μL of the iron(III) nitrate-ethylene glycol solution and 30 μL of the sodium sulfide-ethylene glycol solution were added thereto. 20 minutes later, 1.5 mL of the silver nitrate-ethylene glycol solution was added to the solution and then the reaction solution was reacted at 110° C. for 15 hours without stirring. In the same manner as Example 1, solvent substitution was performed to a silver nanowire solution synthesized through the above-described process. Thus, silver nanowires were obtained.

Figure 11:
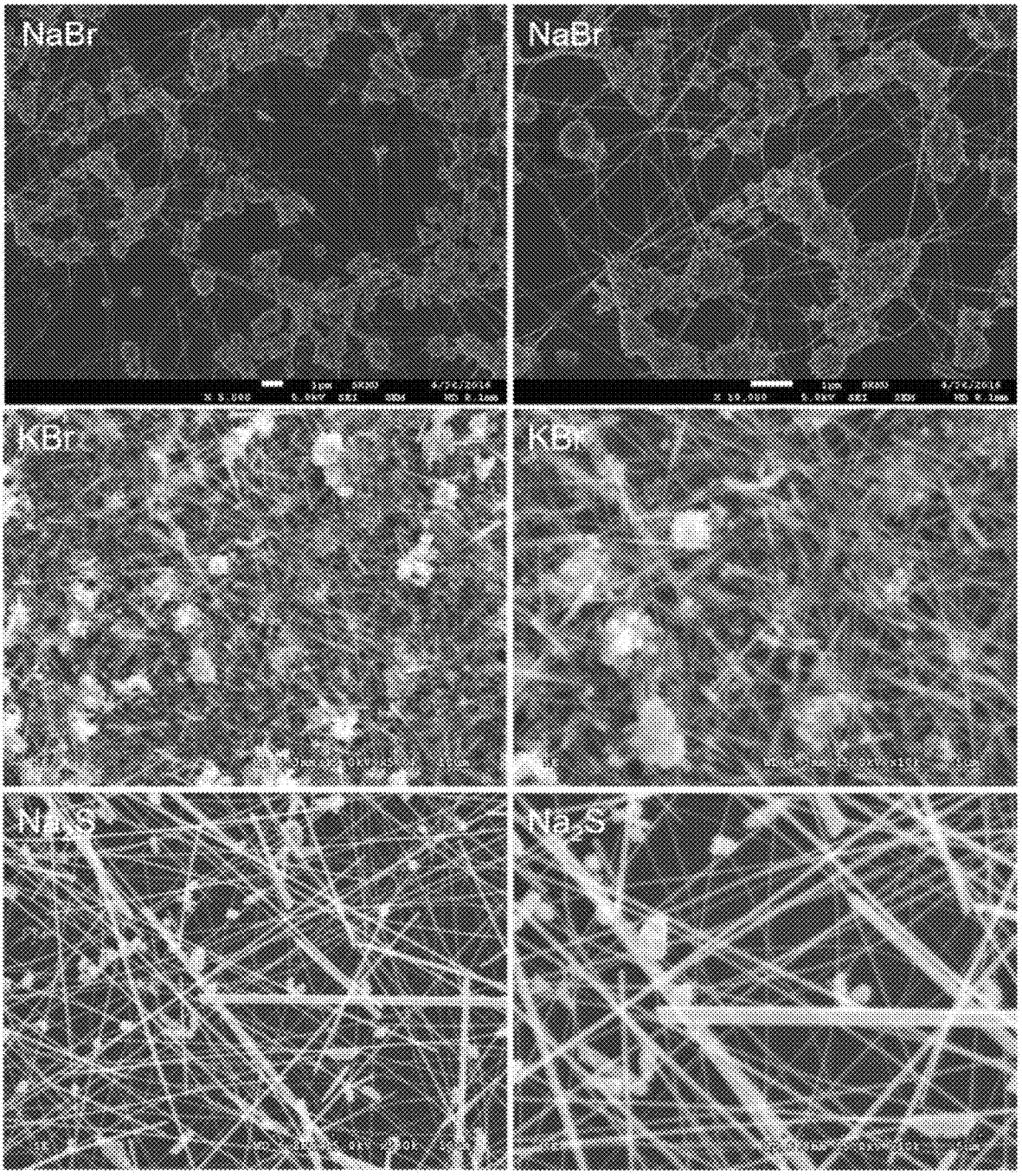
FIG. 11 shows low-magnification and high-magnification SEM images of silver nanowires synthesized using iron(III) nitrate and various salts, according to an example of the present disclosure.

FIG. 11 shows low-magnification and high-magnification SEM images of the silver nanowires obtained in Example 4 (using KBr as a salt), Example 5 (using NaBr as a salt), and Example 6 (using $Na_2S$ as a salt), respectively.

Example 7: Synthesis of Silver Nanowire Based on Iron(III) Chloride

A silver nanowire was synthesized using silver nitrate ($AgNO_3$, Sigma-Aldrich) as a metal precursor, iron(III) chloride ($FeCl_3$, Alfa-Aesar) as a salt, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and 40 mM iron(III) chloride-ethylene glycol solution (salt-containing solution) was prepared by dissolving iron(III) chloride in ethylene glycol.

After 6.32 mL of the ethylene glycol was pre-heated at 110° C. for 1 hour, 150 μL of the iron(III) chloride-ethylene glycol solution was added thereto. 20 minutes later, 1.5 mL of the silver nitrate-ethylene glycol solution was added to the solution and then the reaction solution was reacted at 110° C. for 15 hours without stirring.

Figure 12:
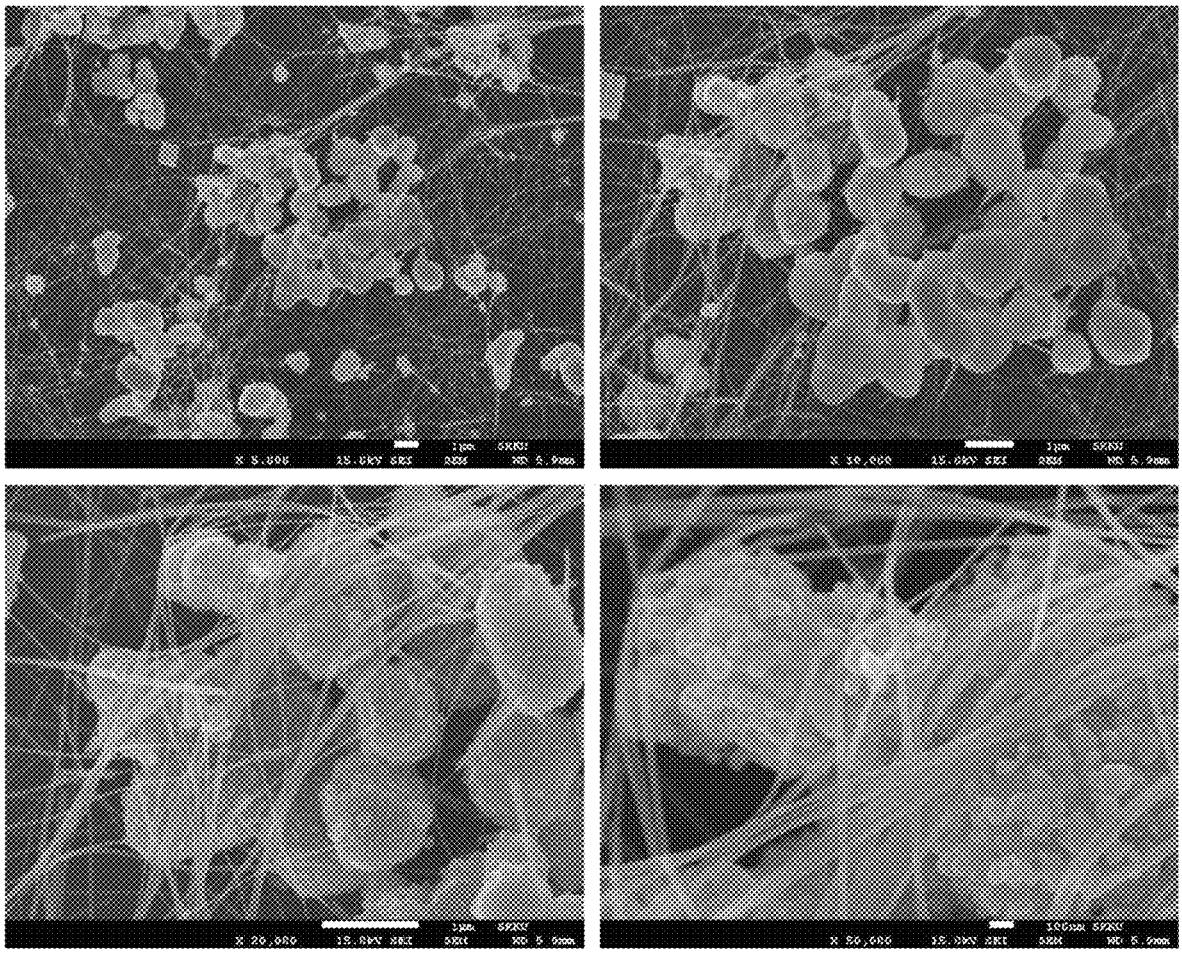
FIG. 12 shows low-magnification and high-magnification SEM images of silver nanowires synthesized using iron(III) chloride as a salt, according to an example of the present disclosure.

In the same manner as Example 1, solvent substitution was performed to a silver nanowire solution synthesized through the above-described process. Thus, silver nanowires were obtained. FIG. 12 shows low-magnification and high-magnification SEM images of the silver nanowires obtained in Example 7.

Example 8: Synthesis of Silver Nanowire Based on Silver Chloride and Iron(III) Nitrate A silver nanowire was synthesized using silver nitrate ($AgNO_3$, Sigma-Aldrich) as a metal precursor, silver chloride (AgCl, Alfa-Aeser) and iron(III) nitrate ($Fe(NO_3)_3$, Sigma-Aldrich) as salts, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 40 mM iron(III) nitrate-ethylene glycol solution (salt-containing solution) was prepared by dissolving iron(III) nitrate in ethylene glycol.

After 21.5 mg of silver chloride was injected into 6.32 mL of the ethylene glycol and pre-heated at 110° C. for 1 hour, 150 μL of the iron(III) nitrate-ethylene glycol solution was added thereto. 20 minutes later, 1.5 mL of the silver nitrate-ethylene glycol solution was added to the solution and then the reaction solution was reacted at 110° C. for 15 hours without stirring.

In the same manner as Example 1, solvent substitution was performed to a silver nanowire solution synthesized through the above-described process. Thus, silver nanowires were obtained.

Figure 13:
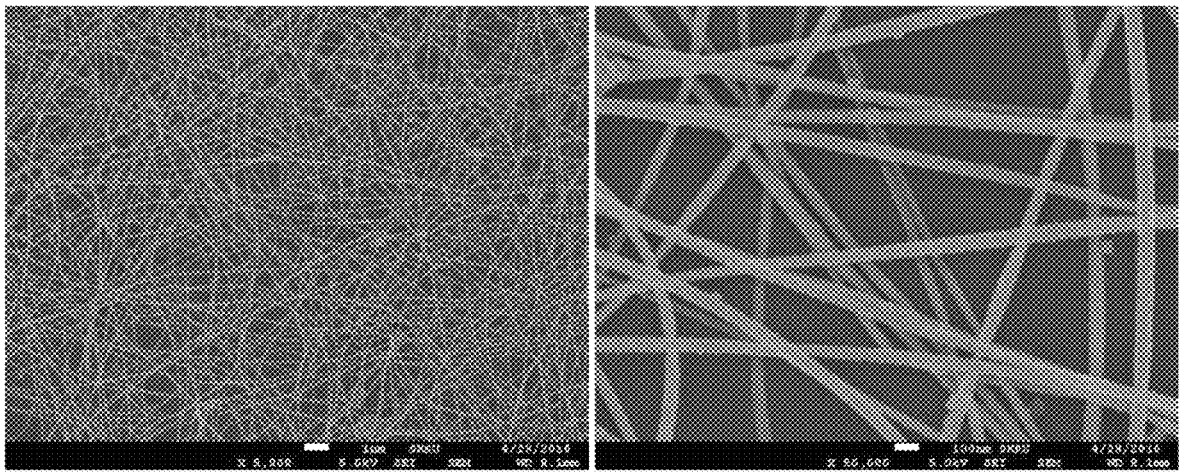
FIG. 13 shows low-magnification and high-magnification SEM images of silver nanowires synthesized using silver chloride and iron(III) nitrate as salts, according to an example of the present disclosure.

FIG. 13 shows SEM images of the silver nanowires prepared using silver chloride and iron(III) nitrate as salts according to Example 8.

Example 9: Synthesis of Silver Nanowire Based on Iron(III) Nitrate

A silver nanowire was synthesized using silver nitrate ($AgNO_3$, Sigma-Aldrich) as a metal precursor, iron(III) nitrate ($Fe(NO_3)_3$, Sigma-Aldrich) as a salt, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol and a 40 mM iron(III) nitrate-ethylene glycol solution (salt-containing solution) was prepared by dissolving iron(III) nitrate in ethylene glycol.

After 6.35 mL of the ethylene glycol was pre-heated at 110° C. for 1 hour, 150 μL of the iron(III) nitrate-ethylene glycol solution was added thereto. 20 minutes later, 1.5 mL of the silver nitrate-ethylene glycol solution was added to the solution and then the reaction solution was reacted at 110° C. for 15 hours without stirring.

In the same manner as Example 1, solvent substitution was performed to a silver nanowire solution synthesized through the above-described process. Thus, silver nanowires were obtained.

Figure 14:
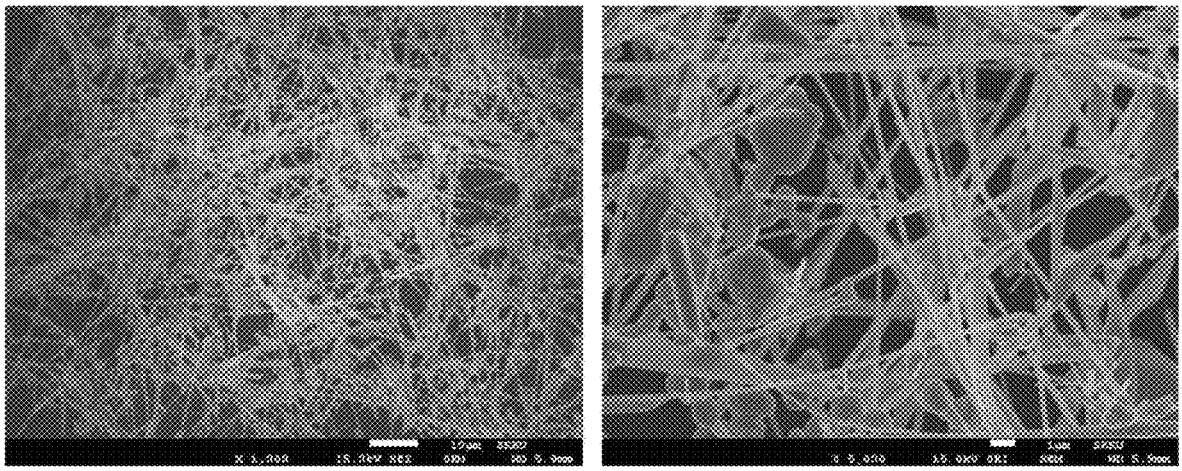
FIG. 14 shows low-magnification and high-magnification SEM images of silver nanowires synthesized using iron(III) nitrate as a salt, according to an example of the present disclosure.

FIG. 14 shows SEM images of the silver nanowires prepared using iron(III) nitrate as a salt according to Example 9.

Comparative Example: Synthesis of Silver Nanowire Based on Iron(III) Nitrate, Sodium Chloride, and Polyvinylpyrrolidone A silver nanowire was synthesized using silver nitrate ($AgNO_3$, Sigma-Aldrich) as a metal precursor, sodium chloride (NaCl, Samchun) and iron(III) nitrate ($Fe(NO_3)_3$, Sigma-Aldrich) as salts, polyvinylpyrrolidone (PVP, Sigma-Aldrich) which has been widely used as a stabilizer for synthesis of silver nanowires according to the prior art, and ethylene glycol (Samchun) as an organic solvent.

A silver nitrate-ethylene glycol solution (metal precursor-containing solution) was prepared by dissolving 25.5 mg of silver nitrate in 1.5 mL of ethylene glycol, and a 30 mM sodium chloride-ethylene glycol solution and a 40 mM iron(III) nitrate-ethylene glycol solution (salt-containing solutions) were prepared by dissolving sodium chloride and iron(III) nitrate, respectively, in ethylene glycol and 0.15 M, 0.225 M, 0.3 M, and 0.75 M polyvinylpyrrolidone-ethylene glycol solutions were prepared by dissolving polyvinylpyrrolidone in ethylene glycol.

After 4.82 mL of the ethylene glycol was pre-heated at 110° C. for 1 hour, 150 μL of the iron(III) nitrate-ethylene glycol solution and 30 μL of the sodium chloride-ethylene glycol solution were added thereto. 15 minutes later, 1.5 mL of the polyvinylpyrrolidone-ethylene glycol solutions was added to the solution and then the reaction solution was reacted at 110° C. for 15 hours without stirring.

In the same manner as Example 1, solvent substitution was performed to a silver nanowire solution synthesized through the above-described process. Thus, silver nanowires were obtained.

Figure 15:
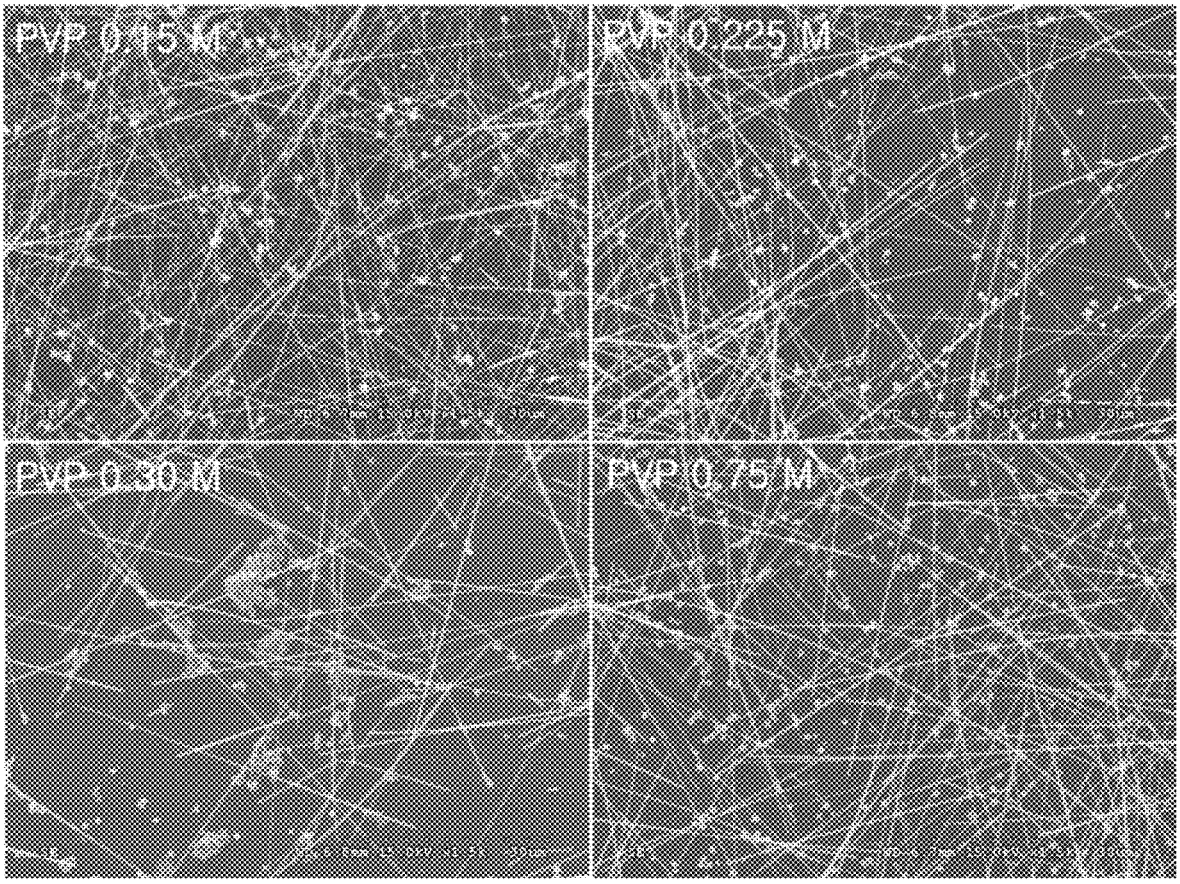
FIG. 15 shows SEM images of silver nanowires synthesized by adding polyvinylpyrrolidone(PVP) which is an organic stabilizer, depending on change in concentration of the PVP, according to Comparative Example.

FIG. 15 shows SEM images of the silver nanowires synthesized using iron(III) nitrate, sodium chloride, and polyvinylpyrrolidone according to Comparative Example.

Figure 16:
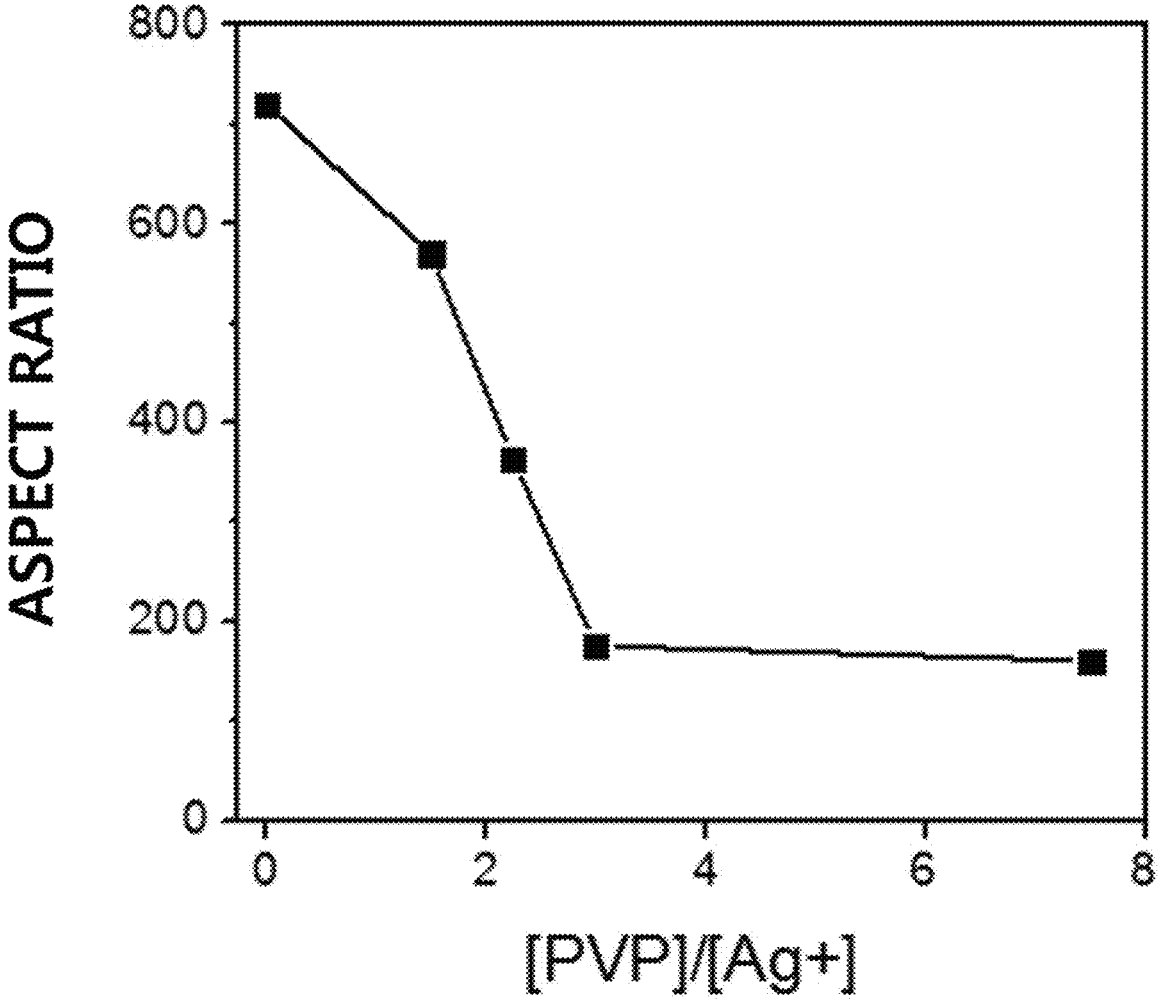
FIG. 16 is a graph showing a change in aspect ratio of a silver nanowire depending on the amount of polyvinylpyrrolidone which is an organic stabilizer, according to Comparative Example.

FIG. 16 is a graph showing aspect ratios depending on a concentration of polyvinylpyrrolidone added to the silver nanowires according to Comparative Example. As shown in FIG. 16, it was confirmed that as a concentration of polyvinylpyrrolidone increases, an aspect ratio decreases.

Example 10: Synthesis of Silver Nanowire Based on Co-Solvent, Iron(III) Nitrate, and Sodium Chloride A silver nanowire was synthesized using silver nitrate ($AgNO_3$, Sigma-Aldrich) as a metal precursor, sodium chloride (NaCl, Samchun) and iron(III) nitrate ($Fe(NO_3)_3$, Sigma-Aldrich) as salts, and ethylene glycol (Samchun) and propylene glycol (Samchun) as organic solvents.

The ethylene glycol and propylene glycol were used as a co-solvent.

A silver nitrate-ethylene glycol solution (metal precursor-containing solution) was prepared by dissolving 76.5 mg of silver nitrate in 3 ml of ethylene glycol and a 30 mM sodium chloride-ethylene glycol solution and a 21 mM iron(III) nitrate-ethylene glycol solution (salt-containing solutions) were prepared by dissolving sodium chloride and iron(III) nitrate, respectively, in ethylene glycol.

After 450 μL of the iron(III) nitrate-ethylene glycol solution, 300 μL of the sodium chloride-ethylene glycol solution, 250 μL of ethylene glycol, and 3 mL of the silver nitrate-ethylene glycol solution were added to 4 ml of the propylene glycol, the reaction solution was aged at room temperature for 0 or 1 hour without stirring and then reacted at 180° C. for 5 minutes.

In the same manner as Example 1, solvent substitution was performed to a silver nanowire solution synthesized through the above-described process. Thus, silver nanowires were obtained.

Figure 17:
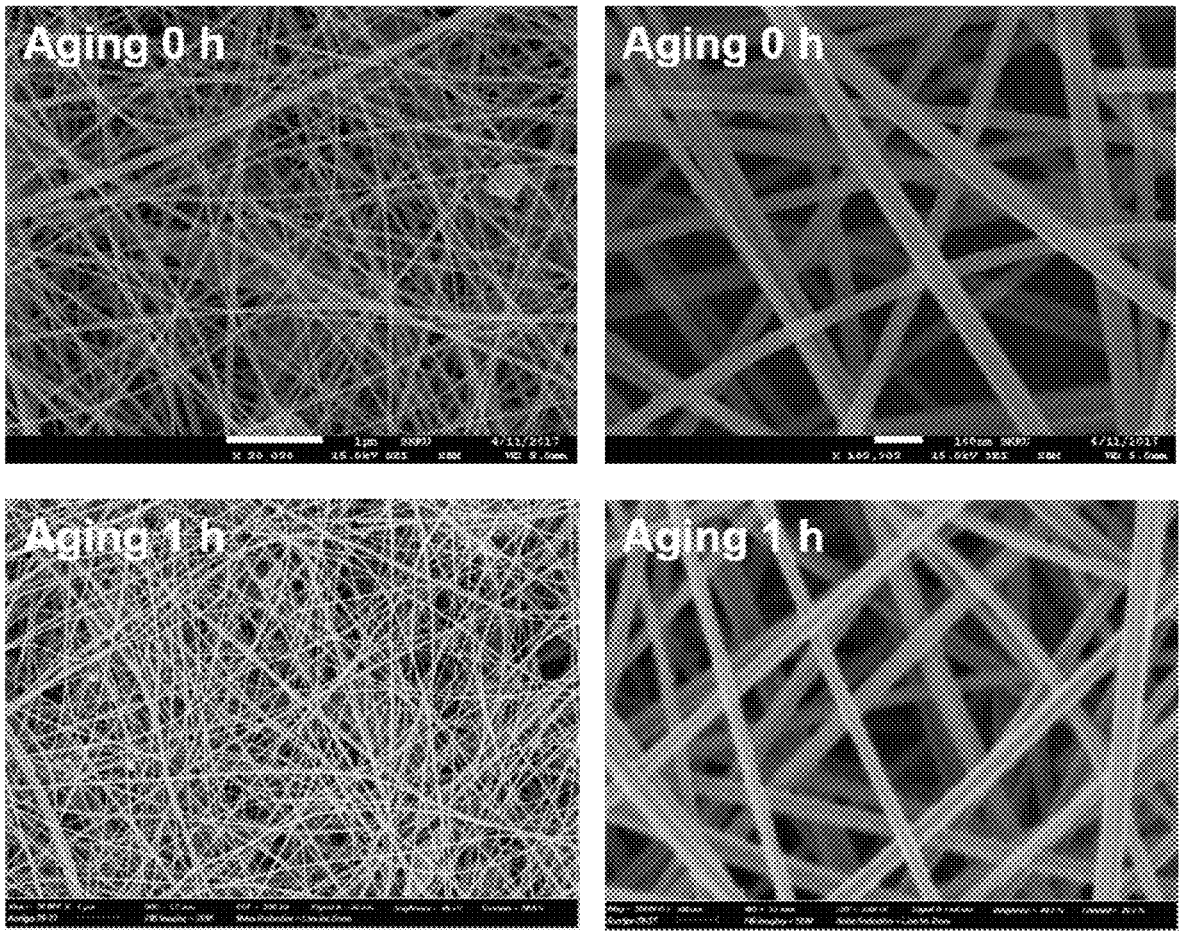
FIG. 17 shows SEM images of silver nanowires synthesized using a co-solvent and sodium chloride and iron(III) nitrate as salts over aging time, according to an example of the present disclosure.

FIG. 17 shows SEM images of the silver nanowires prepared according to Example 10 and confirms a high yield of silver nanowires.

Figure 18:
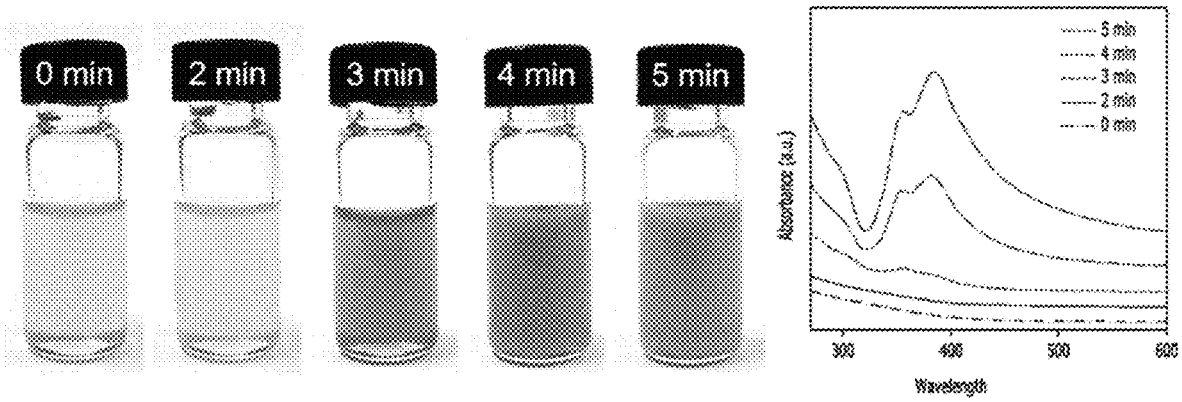
FIG. 18 shows photos and UV-vis spectra of a reaction solution over reaction time when a silver nanowire synthesized using a co-solvent and sodium chloride and iron(III) nitrate as salts is prepared, according to an example of the present disclosure.

FIG. 18 shows UV-vis spectra and photos of the reaction solution over reaction time (1, 2, 3, 4, and 5 minutes) when a silver nanowire was prepared according to Example 10. According to UV-vis spectra, 355 and 385 nm peaks indicating silver nanowires appeared after 3 min.

Example 11: Synthesis of Silver Nanowire Based on Co-Solvent, Iron(III) Nitrate, and Sodium Chloride Depending on Change in Synthesis Temperature A silver nanowire was synthesized using silver nitrate ($AgNO_3$, Sigma-Aldrich) as a metal precursor, sodium chloride (NaCl, Samchun) and iron(III) nitrate ($Fe(NO_3)_3$, Sigma-Aldrich) as salts, and ethylene glycol (Samchun) and propylene glycol (Samchun) as organic solvents.

The ethylene glycol and propylene glycol were used as a co-solvent.

A silver nitrate-ethylene glycol solution (metal precursor-containing solution) was prepared by dissolving 76.5 mg of silver nitrate in 3 ml of ethylene glycol and a 30 mM sodium chloride-ethylene glycol solution and a 21 mM iron(III) nitrate-ethylene glycol solution were prepared by dissolving sodium chloride and iron(III) nitrate, respectively, in ethylene glycol.

After 450 μL of the iron(III) nitrate-ethylene glycol solution, 300 μL of the sodium chloride-ethylene glycol solution, 250 μL of ethylene glycol, and 3 mL of the silver nitrate-ethylene glycol solution were added to 4 ml of the propylene glycol, the reaction solution was left alone at room temperature for 1 hour without stirring and then reacted at 135° C., 150° C., and 165° C. for 60 minutes, 20 minutes, and 10 minutes, respectively.

In the same manner as Example 1, solvent substitution was performed to a silver nanowire solution synthesized through the above-described process. Thus, silver nanowires were obtained.

Figure 19:
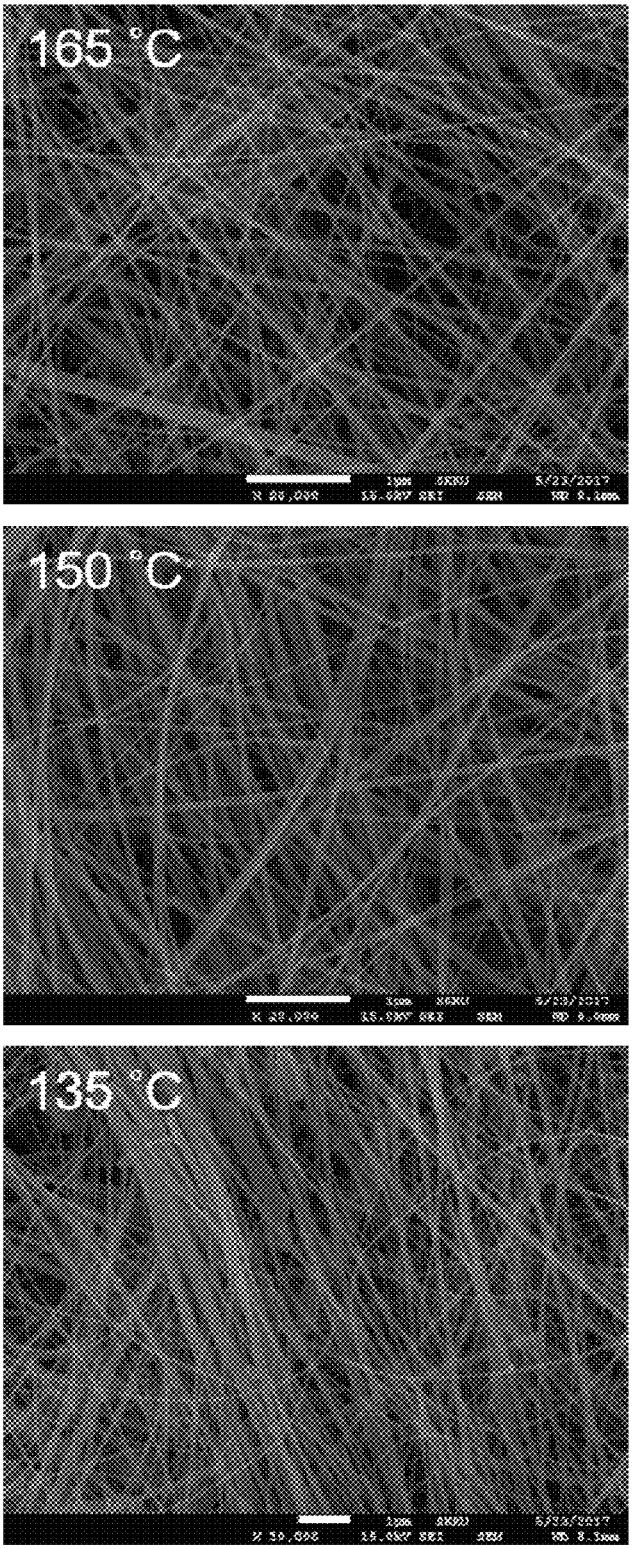
FIG. 19 shows SEM images of silver nanowires synthesized using a co-solvent and sodium chloride and iron(III) nitrate as salts over reaction temperature and reaction time, according to an example of the present disclosure.

FIG. 19 shows SEM images of the silver nanowires prepared according to Example 11 and confirms a high yield of silver nanowires.

Example 12: Preparation of Transparent Flexible Electrode Device Using Synthesized Silver Nanowire The solvent-substituted silver nanowire solution obtained in Example 1 was bar-coated onto a PET film with a Meyer rod to implement a transparent flexible electrode device.

Figure 20:
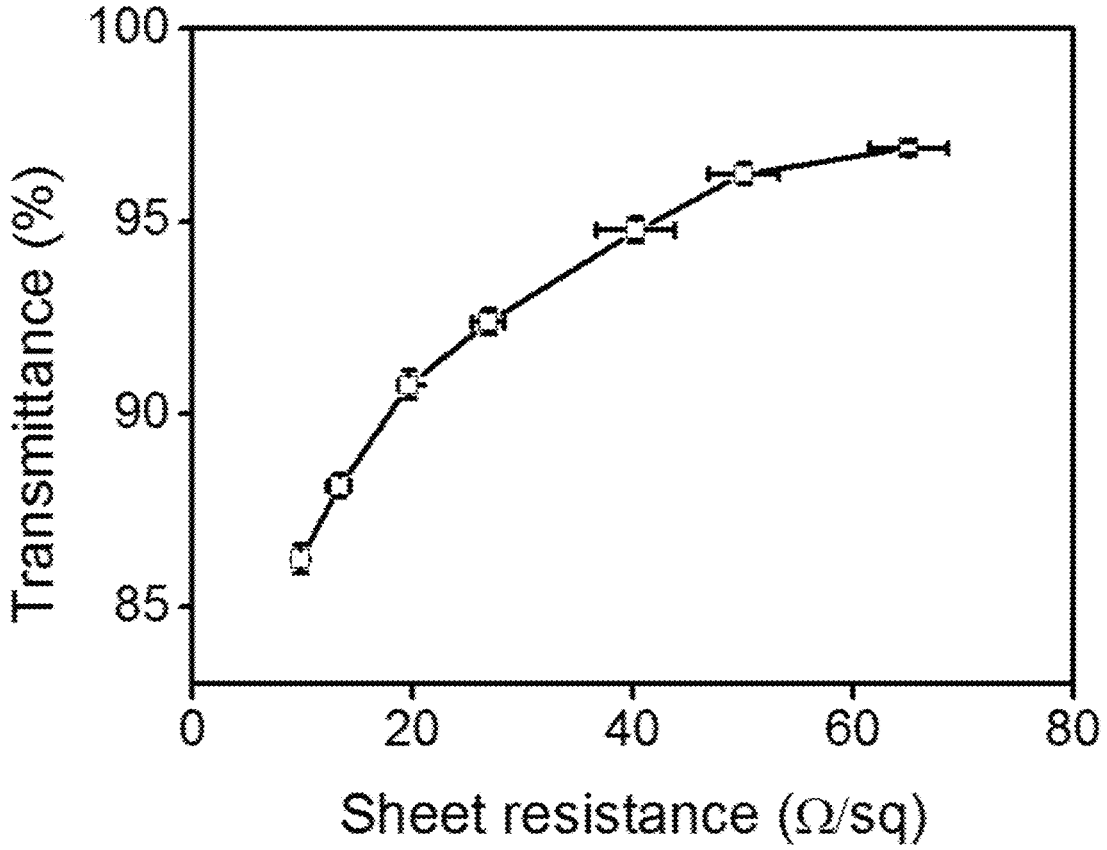
FIG. 20 is a graph showing a characteristic of a transparent electrode employing a silver nanowire synthesized using a combination of iron(III) nitrate and sodium chloride as salts, according to an example of the present disclosure.

FIG. 20 is a graph showing a sheet resistance vs. transmittance of the prepared transparent flexible electrode device. The prepared transparent flexible electrode showed a sheet resistance of 40.22 Ω/sq at a transmittance of 94.78% which is a characteristic of a transparent electrode and similar to that of ITO (50 Ω/sq at 95%).

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

The invention claimed is:

1. A method of preparing a metal nanowire, the method comprising:

adding a metal precursor and a salt into a solvent and making a reaction to form a metal nanowire, wherein the salt includes a combination of a first salt including halides or sulfide salts of alkali metals and halide salts or sulfide salts of Ag metal and a second salt different from the first salt and including a compound represented by the following Chemical Formula 1:

$MA_n$; [Chemical Formula 1]

in Chemical Formula 1, M includes a metal selected from the group consisting of Ni, Cu, Co, Mn, Fe, Na, Ru, Au, Pt, Sn, Pd, Zn, Ti, Ir, Ce, Ca, Rh, Mo, W, B, Li and combinations thereof, A includes a halide group, a nitrate group, a sulfide group, an acetate group, or a sulfate group, and n is 1 to 3, and wherein an organic stabilizer is not used.

2. The method of preparing a metal nanowire of claim 1, wherein the salt includes one or more salts selected from the group consisting of halides of alkali metals, sulfide salts of alkali metals, halide salts of Ag, sulfate salts of Ag, nitrate salts of $Fe^{3+}$, acetate salts of $Fe^{3+}$, sulfate salts of $Fe^{3+}$, halide salts of $Fe^{3+}$, and combinations thereof.

3. The method of preparing a metal nanowire of claim 1, wherein an equivalence ratio of the first salt and the second salt is in the range of from 0.01 to 1,000.

4. The method of preparing a metal nanowire of claim 1, wherein the salt includes one or more salts selected from the group consisting of NaCl, $Na_2S$, KBr, NaBr, AgCl, $FeCl_3$, $Fe(NO_3)_3$ and combinations thereof.

5. The method of preparing a metal nanowire of claim 1, wherein the metal precursor includes silver (Ag).

6. The method of preparing a metal nanowire of claim 5, wherein the metal precursor includes at least one material selected from the group consisting of silver nitrate, silver silicate, silver trifluoroacetate, silver acetate, silver chloride, silver bromide, silver acetylacetonate, silver iodide, silver sulfide, and combinations thereof.

7. The method of preparing a metal nanowire of claim 1, wherein the solvent includes polyol.

8. The method of preparing a metal nanowire of claim 7, wherein the polyol includes at least one material selected from the group consisting of ethylene glycol, propylene glycol, butylene glycol, butanediol, pentanediol, hexanediol, diethylene glycol, triethylene glycol, tetraethylene glycol, polyethylene glycol, glycerol, and combinations thereof.

9. The method of preparing a metal nanowire of claim 1, wherein a temperature of the reaction is from 25° C. to 300° C.

10. The method of preparing a metal nanowire of claim 1, wherein the metal nanowire has an aspect ratio of 5 or more.

* * * * *